US009637703B2

(12) United States Patent
Matsui et al.

(10) Patent No.: US 9,637,703 B2
(45) Date of Patent: May 2, 2017

(54) LUBRICANT COMPOSITION

(75) Inventors: Shigeki Matsui, Tokyo (JP); Akira Yaguchi, Tokyo (JP); Akio Mutou, Tokyo (JP); Mari Nagae, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days.

(21) Appl. No.: 13/520,722

(22) PCT Filed: Sep. 27, 2010

(86) PCT No.: PCT/JP2010/066710
§ 371 (c)(1),
(2), (4) Date: Jul. 5, 2012

(87) PCT Pub. No.: WO2011/083602
PCT Pub. Date: Jul. 14, 2011

(65) Prior Publication Data

US 2012/0283157 A1 Nov. 8, 2012

(30) Foreign Application Priority Data

Jan. 7, 2010 (JP) ..... 2010-002269

(51) Int. Cl.
*C10M 163/00* (2006.01)
*C10M 159/20* (2006.01)

(52) U.S. Cl.
CPC .. *C10M 163/00* (2013.01); *C10M 2203/1025* (2013.01); *C10M 2207/262* (2013.01); *C10M 2209/084* (2013.01); *C10M 2215/28* (2013.01); *C10M 2219/068* (2013.01); *C10M 2223/045* (2013.01); *C10M 2227/066* (2013.01); *C10N 2220/021* (2013.01); *C10N 2220/022* (2013.01); *C10N 2220/033* (2013.01); *C10N 2230/02* (2013.01); *C10N 2230/06* (2013.01); *C10N 2230/52* (2013.01); *C10N 2230/54* (2013.01); *C10N 2230/68* (2013.01); *C10N 2240/04* (2013.01); *C10N 2240/102* (2013.01); *C10N 2240/104* (2013.01)

(58) Field of Classification Search
CPC ..... C10M 163/00; C10M 2203/1025; C10M 2207/262; C10M 2209/084; C10M 2215/28; C10M 2219/068; C10M 2223/045; C10M 2227/066; C10N 2220/021; C10N 2220/022; C10N 2220/023; C10N 2230/02; C10N 2230/06; C10N 2230/52; C10N 2230/54; C10N 2230/68; C10N 2240/102; C10N 2240/104
USPC ..... 508/158, 363, 502, 469
See application file for complete search history.

(56) References Cited

U.S. PATENT DOCUMENTS

| | | | | |
|---|---|---|---|---|
| 4,792,410 | A | 12/1988 | Schwind et al. | |
| 2003/0148895 | A1 | 8/2003 | Robson et al. | |
| 2004/0204325 | A1 | 10/2004 | Takahashi | |
| 2005/0176593 | A1 | 8/2005 | Ward, Jr. et al. | |
| 2007/0123437 | A1 | 5/2007 | Boffa et al. | |
| 2007/0179070 | A1* | 8/2007 | Kurihara et al. | 508/460 |
| 2008/0248981 | A1* | 10/2008 | Matsui et al. | 508/382 |
| 2008/0300154 | A1 | 12/2008 | Duchesne et al. | |
| 2011/0053815 | A1 | 3/2011 | Matsui et al. | |

FOREIGN PATENT DOCUMENTS

| | | | |
|---|---|---|---|
| EP | 0447916 | | 9/1991 |
| EP | 0562172 | | 9/1993 |
| EP | 1734105 | | 12/2006 |
| EP | 2000523 | | 12/2008 |
| EP | 2241611 | | 10/2010 |
| JP | 1-501801 | A | 6/1989 |
| JP | 6-306384 | A | 11/1994 |
| JP | 8-302378 | A | 11/1996 |
| JP | 9-111275 | A | 4/1997 |
| JP | 2001-279287 | A | 10/2001 |
| JP | 2002-129182 | A | 5/2002 |
| JP | 2003-96483 | A | 4/2003 |
| JP | 2003-138285 | A | 5/2003 |
| JP | 2005-524758 | A | 8/2005 |
| JP | 2007-154196 | A | 6/2007 |
| JP | 2008-297547 | A | 12/2008 |
| JP | 2009-161612 | | 7/2009 |
| JP | 2009-191246 | | 8/2009 |
| JP | 2009-191247 | | 8/2009 |
| WO | 2009/072524 | | 6/2009 |
| WO | 2009/090921 | | 7/2009 |

OTHER PUBLICATIONS

Office action in Chinese Application No. 201080060885.4, dated Apr. 3, 2013.
Search report from E.P.O. for EP Application No. 10 84 2117, mail date is Oct. 16, 2013.
International Search Report for PCT/JP2010/066710, mailed Oct. 19, 2010.
English-language translation of International Preliminary Report on Patentability issued with respect to PCT/JP2010/066710, mailed Aug. 23, 2012.
Chinese Office Action for Application No. 201410016322.5, which was mailed on Feb. 5, 2015.
X. Wang, "Practical Manual for Raw Material and Equipment of Manufacturing Lubricating Grease", *China Petrochemical Press*, sections 3.4.10 to 3.4.11 2006; along with a translation of those sections.

(Continued)

*Primary Examiner* — James Goloboy
(74) *Attorney, Agent, or Firm* — Greenblum & Bernstein, P.L.C.

(57) ABSTRACT

The lubricating oil composition of the invention comprises a lubricating base oil with a 100° C. kinematic viscosity of 1-20 $mm^2/s$, (A) a friction modifier, (B) a first overbased metal salt obtained by overbasing an oil-soluble metal salt with an alkaline earth metal borate, and (C) an overbased second oil-soluble metal salt obtained by overbasing an oil-soluble metal salt with an alkaline earth metal carbonate.

2 Claims, No Drawings

(56) References Cited

OTHER PUBLICATIONS

Office Action issued in China Counterpart Patent Appl. No. 201410016322.5, dated Oct. 21, 2015.

Office Action for JP Patent Application No. 2010-002269, which was mailed on Apr. 22, 2014.

Chinese Office Action issued with respect to Application No. 201410016322.5, dated Jan. 11, 2017.

Wenxuan Huang, "Section5 Oilness Additives and Friction Modifiers", China Petrochemical Press Co., Ltd, Feb. 2003.

* cited by examiner

LUBRICANT COMPOSITION

TECHNICAL FIELD

The present invention relates to a lubricating oil composition.

BACKGROUND ART

Lubricating oils have been used in the past in internal combustion engines, gearboxes and other mechanical devices to promote smoother functioning. Internal combustion engine lubricating oils (engine oils), in particular, must exhibit a high level of performance under the high-performance, high-output and harsh operating conditions of internal combustion engines. Various additives such as anti-wear agents, metal cleaning agents, non-ash powders and antioxidants are therefore added to conventional engine oils to meet such performance demands (see Patent documents 1-3). In addition, the fuel efficiency performance required of lubricating oils has continued to increase in recent years, and this has led to application of various high-viscosity-index base oils or friction modifiers (see Patent document 4, for example).

CITATION LIST

Patent Literature

[Patent document 1] Japanese Unexamined Patent Application Publication No. 2001-279287
[Patent document 2] Japanese Unexamined Patent Application Publication No. 2002-129182
[Patent document 3] Japanese Unexamined Patent Application Publication HEI No. 08-302378
[Patent document 4] Japanese Unexamined Patent Application Publication HEI No. 06-306384

SUMMARY OF INVENTION

Technical Problem

Conventional lubricating oils, however, cannot necessarily be considered adequate in terms of fuel efficiency.

For example, one common method that is known for achieving fuel efficiency involves reducing the kinematic viscosity of the lubricating oil and increasing the viscosity index (multigrading by a combination of a low-viscosity base oil and a viscosity index improver), or adding a friction reducer. With viscosity reduction, however, the reduction in viscosity of the lubricating oil or the base oil composing it can reduce the lubricating performance under severe lubrication conditions (high-temperature, high-shear conditions), resulting in wear and seizing, as well as leading to problems such as fatigue fracture. Also, ash-free or molybdenum-based friction modifiers are known, for addition of friction reducers, but fuel-efficient oils are desired that are even more superior than these common friction reducer-containing oils.

While it is effective to raise the 150° C. HTHS viscosity (the "HTHS viscosity" is also known as "high-temperature high-shear viscosity") and lower the 40° C. kinematic viscosity, the 100° C. kinematic viscosity and the 100° C. HTHS viscosity, in order to impart fuel efficiency while preventing the inconveniences of viscosity reduction and maintaining durability, it has been extremely difficult to satisfy all of these conditions with conventional lubricating oils. It is also known that mere reduction in viscosity increases the friction coefficient in the boundary lubrication region in which metals contact. In order to increase fuel efficiency, it is also necessary to lower the friction coefficient in the boundary lubrication region.

The present invention has been accomplished in light of these circumstances, and its object is to provide a lubricating oil composition with excellent fuel efficiency, that can sufficiently lower the 40° C. kinematic viscosity, 100° C. kinematic viscosity and 100° C. HTHS viscosity, while maintaining the 150° C. HTHS viscosity, and can sufficiently minimize increase in the friction coefficient in the boundary lubrication region.

Solution to Problem

In order to solve the problems described above, the invention provides a lubricating oil composition comprising a lubricating base oil with a 100° C. kinematic viscosity of 1-20 $mm^2/s$, (A) a friction modifier, (B) a first overbased metal salt obtained by overbasing an oil-soluble metal salt with an alkaline earth metal borate, and (C) a second overbased metal salt obtained by overbasing an oil-soluble metal salt with an alkaline earth metal carbonate.

The (A) friction modifier is preferably an organic molybdenum-based friction modifier.

The (B) first overbased metal salt is preferably an overbased alkaline earth metal salicylate obtained by overbasing an alkaline earth metal salicylate with an alkaline earth metal borate.

The lubricating oil composition of the invention also preferably comprises (D) a viscosity index improver with a PSSI of no greater than 40 and a ratio between the molecular weight and PSSI (Mw/PSSI) of $1\times10^4$ or greater.

The abbreviation "PSSI" used for the invention stands for the "Permanent Shear Stability Index" of the polymer, which is calculated according to ASTM D 6022-01 (Standard Practice for Calculation of Permanent Shear Stability Index) based on data measured according to ASTM D 6278-02 (Test Method for Shear Stability of Polymer Containing Fluids Using a European Diesel Injector Apparatus).

Advantageous Effects of Invention

As mentioned above, according to the invention it is possible to provide a lubricating oil composition with excellent fuel efficiency, that can sufficiently lower the 40° C. kinematic viscosity, 100° C. kinematic viscosity and 100° C. HTHS viscosity, and sufficiently minimize increase in the friction coefficient in the boundary lubrication region, while maintaining its 150° C. HTHS viscosity.

The lubricating oil composition of the invention is also useful for gasoline engines, diesel engines and gas engines for two-wheel vehicles, four-wheel vehicles, electric power generation and cogeneration, and the like, while it can be suitably used not only for such engines that run on fuel with a sulfur content of no greater than 50 ppm by mass, but also for ship engines, outboard motor engines and the like.

DESCRIPTION OF EMBODIMENTS

Preferred embodiments of the invention will now be described in detail.

The lubricating oil composition of this embodiment comprises a lubricating base oil with a 100° C. kinematic viscosity of 1-20 $mm^2/s$, (A) a friction modifier, (B) a first overbased metal salt obtained by an oil-soluble metal salt with an alkaline earth metal borate, and (C) a second overbased metal salt obtained by overbasing an oil-soluble metal salt with an alkaline earth metal carbonate.

For the lubricating oil composition of this embodiment there was used a lubricating base oil having a 100° C. kinematic viscosity of 1-20 $mm^2/s$ (hereunder referred to as "lubricating base oil of this embodiment").

Examples for the lubricating base oil of this embodiment include purified paraffinic mineral oils produced by subjecting a lube-oil distillate obtained by atmospheric distillation and/or vacuum distillation of crude oil to a single treatment or two or more treatments from among refining treatments such as solvent deasphalting, solvent extraction, hydrocracking, solvent dewaxing, catalytic dewaxing, hydrorefining, sulfuric acid cleaning or white clay treatment, or normal paraffinic base oils, isoparaffinic base oils and the like, whose 100° C. kinematic viscosities are 1-20 $mm^2/s$.

A preferred example for the lubricating base oil of this embodiment is a base oil obtained by using one of the base oils (1)-(8) mentioned below as the raw material and purifying this stock oil and/or the lube-oil distillate recovered from the stock oil by a prescribed refining process, and recovering the lube-oil distillate.

(1) Distilled oil from atmospheric distillation of a paraffin-based crude oil and/or mixed-base crude oil.

(2) Distilled oil from vacuum distillation of atmospheric distillation residue oil from paraffin-based crude oil and/or mixed-base crude oil (WVGO).

(3) Wax obtained by a lubricating oil dewaxing step (slack wax or the like) and/or synthetic wax obtained by a gas-to-liquid (GTL) process (Fischer-Tropsch wax, GTL wax or the like).

(4) Blended oil comprising one or more oils selected from among base oils (1)-(3) and/or mild-hydrocracked oil obtained from the blended oil.

(5) Blended oil comprising two or more selected from among base oils (1)-(4).

(6) Deasphalted oil (DAO) from base oil (1), (2), (3), (4) or (5).

(7) Mild-hydrocracked oil (MHC) obtained from base oil (6).

(8) Blended oil comprising two or more selected from among base oils (1)-(7).

The prescribed refining process described above is preferably hydrorefining such as hydrocracking or hydrofinishing; solvent refining such as furfural solvent extraction; dewaxing such as solvent dewaxing or catalytic dewaxing; white clay refining with acidic white clay or active white clay, or chemical (acid or alkali) washing such as sulfuric acid treatment or caustic soda washing. According to the invention, any one of these refining processes may be used alone, or a combination of two or more thereof may be used in combination. When a combination of two or more refining processes is used, their order is not particularly restricted and it may be selected as appropriate.

The lubricating base oil of this embodiment is most preferably one of the following base oils (9) or (10) obtained by prescribed treatment of a base oil selected from among base oils (1)-(8) above or a lube-oil distillate recovered from the base oil.

(9) Hydrocracked mineral oil obtained by hydrocracking of a base oil selected from among base oils (1)-(8) above or a lube-oil distillate recovered from the base oil, dewaxing treatment such as solvent dewaxing or catalytic dewaxing of the product or a lube-oil distillate recovered from distillation of the product, or further distillation after the dewaxing treatment.

(10) Hydroisomerized mineral oil obtained by hydroisomerization of a base oil selected from among base oils (1)-(8) above or a lube-oil distillate recovered from the base oil, and dewaxing treatment such as solvent dewaxing or catalytic dewaxing of the product or a lube-oil distillate recovered from distillation of the product, or further distillation after the dewaxing treatment.

For obtaining the lubricating base oil of (9) or (10) above, a solvent refining treatment and/or hydrofinishing treatment step may also be carried out by convenient steps if necessary.

There are no particular restrictions on the catalyst used for the hydrocracking and hydroisomerization, but there are preferably used hydrocracking catalysts comprising a hydrogenating metal (for example, one or more metals of Group VIa or metals of Group VIII of the Periodic Table) supported on a carrier which is a complex oxide with decomposing activity (for example, silica-alumina, alumina-boria, silica-zirconia or the like) or a combination of two or more of such complex oxides bound with a binder, or hydroisomerization catalysts obtained by supporting one or more metals of Group VIII having hydrogenating activity on a carrier comprising zeolite (for example, ZSM-5, zeolite beta, SAPO-11 or the like). The hydrocracking catalyst or hydroisomerization catalyst may be used as a combination of layers or a mixture.

The reaction conditions for hydrocracking and hydroisomerization are not particularly restricted, but preferably the hydrogen partial pressure is 0.1-20 MPa, the mean reaction temperature is 150-450° C., the LHSV is 0.1-3.0 $hr^{-1}$ and the hydrogen/oil ratio is 50-20,000 scf/b.

The 100° C. kinematic viscosity of the lubricating base oil of this embodiment must be no greater than 20 $mm^2/s$, and is preferably no greater than 10 $mm^2/s$, more preferably no greater than 7 $mm^2/s$, even more preferably no greater than 5.0 $mm^2/s$, especially preferably no greater than 4.5 $mm^2/s$ and most preferably no greater than 4.0 $mm^2/s$. The 100° C. kinematic viscosity, on the other hand, must be 1 $mm^2/s$ or greater, and it is preferably 1.5 $mm^2/s$ or greater, more preferably 2 $mm^2/s$ or greater, even more preferably 2.5 $mm^2/s$ or greater and most preferably 3 $mm^2/s$ or greater. The 100° C. kinematic viscosity is the 100° C. kinematic viscosity measured according to ASTM D-445. If the 100° C. kinematic viscosity of the lubricating base oil exceeds 20 $mm^2/s$, the low-temperature viscosity characteristic may be impaired and sufficient fuel efficiency may not be obtained, while if it is less than 1 $mm^2/s$, oil film formation at the lubricated sections will be inadequate, resulting in inferior lubricity and potentially large evaporation loss of the lubricating oil composition.

According to this embodiment, a lubricating base oil having a 100° C. kinematic viscosity in one of the following ranges is preferably used after fractionation by distillation or the like.

(I) A lubricating base oil with a 100° C. kinematic viscosity of at least 1.5 $mm^2/s$ and less than 3.5 $mm^2/s$, and more preferably 2.0-3.0 $mm^2/s$.

(II) A lubricating base oil with a 100° C. kinematic viscosity of at least 3.5 $mm^2/s$ and less than 4.5 $mm^2/s$, and more preferably 3.7-4.3 $mm^2/s$.

(III) A lubricating base oil with a 100° C. kinematic viscosity of 4.5-10 $mm^2/s$, more preferably 4.8-9 $mm^2/s$ and most preferably 5.5-8.0 $mm^2/s$.

The 40° C. kinematic viscosity of the lubricating base oil of this embodiment is also preferably no greater than 80 $mm^2/s$, more preferably no greater than 50 $mm^2/s$, even more preferably no greater than 20 $mm^2/s$, yet more preferably no greater than 18 $mm^2/s$ and most preferably no greater than 16 $mm^2/s$. Also, the 40° C. kinematic viscosity is preferably 6.0 $mm^2/s$ or greater, more preferably 8.0 $mm^2/s$ or greater, even more preferably 12 $mm^2/s$ or greater, yet more preferably 14 $mm^2/s$ or greater and most preferably 15 $mm^2/s$ or greater. If the 40° C. kinematic viscosity of the lubricating base oil exceeds 80 $mm^2/s$, the low-temperature viscosity characteristic may be impaired and sufficient fuel efficiency may not be obtained, while if it is less than 6.0 $mm^2/s$, oil film formation at the lubricated sections will be inadequate, resulting in inferior lubricity and potentially large evaporation loss of the lubricating oil composition. Also according to this embodiment, a lube-oil distillate having a 40° C. kinematic viscosity in one of the following ranges is preferably used after fractionation by distillation or the like.

(IV) A lubricating base oil with a 40° C. kinematic viscosity of at least 6.0 $mm^2/s$ and less than 12 $mm^2/s$, and more preferably 8.0-12 $mm^2/s$.

(V) A lubricating base oil with a 40° C. kinematic viscosity of at least 12 $mm^2/s$ and less than 28 $mm^2/s$, and more preferably 13-19 $mm^2/s$.

(VI) A lubricating base oil with a 40° C. kinematic viscosity of 28-50 $mm^2/s$, more preferably 29-45 $mm^2/s$ and most preferably 30-40 $mm^2/s$.

The viscosity index of the lubricating base oil of this embodiment is preferably 120 or greater. Also, the viscosity index for the lubricating base oils (I) and (IV) is preferably 120-135 and more preferably 120-130. The viscosity index for the lubricating base oils (II) and (V) is preferably 120-160, more preferably 125-150 and even more preferably 130-145. Also, the viscosity index for the lubricating base oils (III) and (VI) is preferably 120-180 and more preferably 125-160. A viscosity index below these lower limits will not only impair the viscosity-temperature characteristic, heat and oxidation stability and resistance to volatilization, but will also tend to increase the friction coefficient and potentially lower the anti-wear property. If the viscosity index exceeds the aforementioned upper limit, the low-temperature viscosity characteristic will tend to be reduced.

The viscosity index for the purpose of the invention is the viscosity index measured according to JIS K 2283-1993.

The 15° C. density ($\rho_{15}$) of the lubricating base oil of this embodiment will also depend on the viscosity grade of the lubricating base oil component, but it is preferably no greater than the value of $\rho$ represented by the following formula (A), i.e., $\rho_{15} \leq \rho$.

$$\rho = 0.0025 \times kv100 + 0.816 \quad (A)$$

[In this equation, kv100 represents the 100° C. kinematic viscosity ($mm^2/s$) of the lubricating base oil.]

If $\rho_{15} > \rho$, the viscosity-temperature characteristic and heat and oxidation stability, as well as the resistance to volatilization and the low-temperature viscosity characteristic, will tend to be lowered, thus potentially impairing the fuel efficiency. In addition, the efficacy of additives included in the lubricating base oil may be reduced.

Specifically, the 15° C. density ($\rho_{15}$) of the lubricating base oil of the invention is preferably no greater than 0.860, more preferably no greater than 0.850, even more preferably no greater than 0.840 and most preferably no greater than 0.822.

The 15° C. density for the purpose of the invention is the density measured at 15° C. according to JIS K 2249-1995.

The pour point of the lubricating base oil of this embodiment will depend on the viscosity grade of the lubricating base oil, and for example, the pour point for the lubricating base oils (I) and (IV) is preferably no higher than −10° C., more preferably no higher than −12.5° C. and even more preferably no higher than −15° C. Also, the pour point for the lubricating base oils (II) and (V) is preferably no higher than −10° C., more preferably no higher than −15° C. and even more preferably no higher than −17.5° C. The pour point for the lubricating base oils (III) and (VI) is preferably no higher than −10° C., more preferably no higher than −12.5° C. and even more preferably no higher than −15° C. If the pour point exceeds the upper limit specified above, the low-temperature flow properties of a lubricating oil employing the lubricating base oil will tend to be reduced. The pour point for the purpose of the invention is the pour point measured according to JIS K 2269-1987.

The aniline point (AP (° C.)) of the lubricating base oil of this embodiment will also depend on the viscosity grade of the lubricating base oil, but it is preferably greater than or equal to the value of A as represented by the following formula (B), i.e., AP≥A.

$$A = 4.3 \times kv100 + 100 \quad (B)$$

[In this equation, kv100 represents the 100° C. kinematic viscosity ($mm^2/s$) of the lubricating base oil.]

If AP<A, the viscosity-temperature characteristic, heat and oxidation stability, resistance to volatilization and low-temperature viscosity characteristic of the lubricating base oil will tend to be reduced, while the efficacy of additives when added to the lubricating base oil will also tend to be reduced.

The AP for the lubricating base oils (I) and (IV) is preferably 108° C. or higher and more preferably 110° C. or higher. The AP for the lubricating base oils (II) and (V) is preferably 113° C. or higher and more preferably 119° C. or higher. Also, the AP for the lubricating base oils (III) and (VI) is preferably 125° C. or higher and more preferably 128° C. or higher. The aniline point for the purpose of the invention is the aniline point measured according to JIS K 2256-1985.

The iodine value of the lubricating base oil of this embodiment is preferably no greater than 3, more preferably no greater than 2, even more preferably no greater than 1, yet more preferably no greater than 0.9 and most preferably no greater than 0.8. Although the value may be less than 0.01, in consideration of the fact that this does not produce any further significant effect and is uneconomical, the value is preferably 0.001 or greater, more preferably 0.01 or greater, even more preferably 0.03 or greater and most preferably 0.05 or greater. Limiting the iodine value of the lubricating base oil component to no greater than 3 can drastically improve the heat and oxidation stability. The "iodine value" for the purpose of the invention is the iodine value measured by the indicator titration method according to JIS K 0070, "Acid Values, Saponification Values, Iodine Values, Hydroxyl Values And Unsaponification Values Of Chemical Products".

The sulfur content in the lubricating base oil of this embodiment will depend on the sulfur content of the starting material. For example, when using a substantially sulfur-free starting material as for synthetic wax components obtained by Fischer-Tropsch reaction, it is possible to obtain a substantially sulfur-free lubricating base oil. When using a sulfur-containing starting material, such as slack wax obtained by a lubricating base oil refining process or microwax obtained by a wax refining process, the sulfur content of the obtained lubricating base oil will normally be 100 ppm by mass or greater. From the viewpoint of further improving the heat and oxidation stability and reducing sulfur, the sulfur content in the lubricating base oil of this embodiment is preferably no greater than 100 ppm by mass, more preferably no greater than 50 ppm by mass, even more preferably no greater than 10 ppm by mass and especially no greater than 5 ppm by mass.

The nitrogen content in the lubricating base oil of this embodiment is not particularly restricted, but is preferably no greater than 7 ppm by mass, more preferably no greater than 5 ppm by mass and even more preferably no greater than 3 ppm by mass. If the nitrogen content exceeds 5 ppm by mass, the heat and oxidation stability will tend to be reduced. The nitrogen content for the purpose of the invention is the nitrogen content measured according to JIS K 2609-1990.

The % $C_P$ value of the lubricating base oil of this embodiment is preferably at least 70, and it is preferably 80-99, more preferably 85-95, even more preferably 87-94 and most preferably 90-94. If the % $C_P$ value of the lubricating base oil is less than the aforementioned lower limit, the viscosity-temperature characteristic, heat and oxidation stability and frictional properties will tend to be reduced, while the efficacy of additives when added to the lubricating base oil will also tend to be reduced. If the % $C_P$ value of the lubricating base oil is greater than the aforementioned upper limit, on the other hand, the additive solubility will tend to be lower.

The % $C_A$ of the lubricating base oil of this embodiment is preferably no greater than 2, and it is more preferably no greater than 1, even more preferably no greater than 0.8 and most preferably no greater than 0.5. If the % $C_A$ value of the lubricating base oil exceeds the aforementioned upper limit, the viscosity-temperature characteristic, heat and oxidation stability and fuel efficiency will tend to be reduced.

The % $C_N$ value of the lubricating base oil of this embodiment is preferably no greater than 30, more preferably 4-25, even more preferably 5-13 and most preferably 5-8. If the % $C_N$ value of the lubricating base oil exceeds the aforementioned upper limit, the viscosity-temperature characteristic, heat and oxidation stability and frictional properties will tend to be reduced. If % $C_N$ is less than the aforementioned lower limit, the additive solubility will tend to be lower.

The % $C_P$, % $C_N$ and % $C_A$ values for the purpose of the invention are, respectively, the percentage of paraffinic carbons with respect to total carbon atoms, the percentage of naphthenic carbons with respect to total carbons and the percentage of aromatic carbons with respect to total carbons, as determined by the method of ASTM D 3238-85 (n-d-M ring analysis). That is, the preferred ranges for % $C_P$, % $C_N$ and % $C_A$ are based on values determined by these methods, and for example, % $C_N$ may be a value exceeding 0 according to these methods even if the lubricating base oil contains no naphthene portion.

The aromatic content in the lubricating base oil of this embodiment is preferably 90% by mass or greater, more preferably 95% by mass or greater and even more preferably 99% by mass or greater based on the total mass of the lubricating base oil, while the proportion of cyclic saturated components of the saturated components is preferably no greater than 40% by mass, more preferably no greater than 35% by mass, even more preferably no greater than 30% by mass, yet more preferably no greater than 25% by mass and most preferably no greater than 21% by mass. The proportion of cyclic saturated components among the saturated components is also preferably 5% by mass or greater and more preferably 10% by mass or greater. If the saturated component content and proportion of cyclic saturated components among the saturated components both satisfy these respective conditions, it will be possible to improve the viscosity-temperature characteristic and heat and oxidation stability, while additives added to the lubricating base oil will be kept in a sufficiently stable dissolved state in the lubricating base oil so that the functions of the additives can be exhibited at a higher level. According to the invention it is also possible to improve the frictional properties of the lubricating base oil itself, and thus result in a greater friction reducing effect and therefore increased energy savings.

The "saturated components" for the purpose of the invention are measured by the method of ASTM D 2007-93.

Other methods may be used for separation of the saturated components or for compositional analysis of the cyclic saturated components and acyclic saturated components, so long as they provide similar results. Examples of other methods include the method according to ASTM D 2425-93, the method according to ASTM D 2549-91, methods of high performance liquid chromatography (HPLC), and modified forms of these methods.

The aromatic content in the lubricating base oil of this embodiment is preferably no greater than 5% by mass, more preferably no greater than 4% by mass, even more preferably no greater than 3% by mass and most preferably no greater than 2% by mass, and also preferably 0.1% by mass or greater, more preferably 0.5% by mass or greater, even more preferably 1% by mass or greater and most preferably 1.5% by mass or greater, based on the total mass of the lubricating base oil. If the aromatic content exceeds the aforementioned upper limit, the viscosity-temperature characteristic, heat and oxidation stability, frictional properties, resistance to volatilization and low-temperature viscosity characteristic will tend to be reduced, while the efficacy of additives when added to the lubricating base oil will also tend to be reduced. The lubricating base oil of the invention may be free of aromatic components, but the solubility of additives can be further increased with an aromatic content above the aforementioned lower limit.

The aromatic content, according to the invention, is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

A synthetic base oil may be used as the lubricating base oil of this embodiment. As synthetic base oils there may be mentioned poly-α-olefins and their hydrogenated forms, isobutene oligomers and their hydrogenated forms, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, which have 100° C. kinematic viscosities of less than 1-20 $mm^2/s$, among which poly-α-olefins are preferred. As typical poly-α-olefins there may be mentioned C2-32 and preferably C6-16 α-olefin oligomers or co-oligomers (1-octene oligomers, decene oligomers, ethylene-propylene co-oligomers and the like), and their hydrogenated forms.

There are no particular restrictions on the process for producing poly-α-olefins, and as an example there may be mentioned a process wherein an α-olefin is polymerized in the presence of a polymerization catalyst such as a Friedel- Crafts catalyst comprising a complex of aluminum trichloride or boron trifluoride with water, an alcohol (ethanol, propanol, butanol or the like) and a carboxylic acid or ester.

The lubricating base oil of this embodiment may be used alone as a lubricating oil composition according to this embodiment, or the lubricating base oil of this embodiment may be combined with one or more other base oils. When the lubricating base oil of this embodiment is combined with another base oil, the proportion of the lubricating base oil of the invention in the total mixed base oil is preferably at least 30% by mass, more preferably at least 50% by mass and even more preferably at least 70% by mass.

There are no particular restrictions on the other base oil used in combination with the lubricating base oil of this embodiment, and as examples of mineral base oils there may be mentioned solvent refined mineral oils, hydrocracked mineral oils, hydrorefined mineral oils and solvent dewaxed base oils having 100° C. kinematic viscosities of greater than 20 $mm^2/s$ and no greater than 100 $mm^2/s$.

Other synthetic base oils to be used in combination with the lubricating base oil of this embodiment include the aforementioned synthetic base oils that have 100° C. kinematic viscosities outside of the range of 1-20 $mm^2/s$.

The lubricating oil composition of this embodiment comprises (A) a friction modifier. This can increase the fuel efficiency performance compared to a composition not having such a construction. The (A) friction modifier may consist of one or more friction modifiers selected from among organic molybdenum compounds and ash-free friction modifiers.

As organic molybdenum compounds to be used for this embodiment there may be mentioned sulfur-containing organic molybdenum compounds such as molybdenum dithiophosphate and molybdenum dithiocarbamate (MoDTC), complexes of molybdenum compounds (for example, molybdenum oxides such as molybdenum dioxide and molybdenum trioxide, molybdic acids such as orthomolybdic acid, paramolybdic acid and (poly)molybdic sulfide acid, molybdic acid salts such as metal salts or ammonium salts of these molybdic acids, molybdenum sulfides such as molybdenum disulfide, molybdenum trisulfide, molybdenum pentasulfide and polymolybdenum sulfide, molybdic sulfide, metal salts or amine salts of molybdic sulfide, molybdenum halides such as molybdenum chloride, and the like), with sulfur-containing organic compounds (for example, alkyl (thio)xanthates, thiadiazole, mercaptothiadiazole, thiocarbonate, tetrahydrocarbylthiuram disulfide, bis(di(thio)hydrocarbyl dithiophosphonate)disulfide, organic (poly)sulfides, sulfurized esters and the like), or other organic compounds, or complexes of sulfur-containing molybdenum compounds such as molybdenum sulfide and molybdic sulfide with alkenylsuccinic acid imides.

The organic molybdenum compound used may be an organic molybdenum compound containing no sulfur as a constituent element. As organic molybdenum compounds containing no sulfur as a constituent element there may be mentioned, specifically, molybdenum-amine complexes, molybdenum-succinic acid imide complexes, organic acid molybdenum salts, alcohol molybdenum salts and the like, among which molybdenum-amine complexes, organic acid molybdenum salts and alcohol molybdenum salts are preferred.

When an organic molybdenum compound is used in the lubricating oil composition of this embodiment, there are no particular restrictions on the content, but it is preferably 0.001% by mass or greater, more preferably 0.005% by mass or greater, even more preferably 0.01% by mass or greater and most preferably 0.03% by mass or greater, and also preferably no greater than 0.2% by mass, more preferably no greater than 0.1% by mass, even more preferably no greater than 0.08% by mass and most preferably no greater than 0.06% by mass, in terms of molybdenum element based on the total mass of the lubricating oil composition. If the content is less than 0.001% by mass, the friction reducing effect of the addition will tend to be insufficient, and the fuel efficiency and heat and oxidation stability of the lubricating oil composition will tend to be insufficient. On the other hand, if the content is greater than 0.2% by mass the effect will not be commensurate with the increased amount, and the storage stability of the lubricating oil composition will tend to be reduced.

As ash-free friction modifiers there may be used any compounds that are commonly used as friction modifiers for lubricating oils, examples of which include C6-50 compounds comprising in the molecule one or more hetero elements selected from among oxygen atoms, nitrogen atoms and sulfur atoms. More specifically, these include ash-free friction modifiers, including amine compounds, fatty acid esters, fatty acid amides, fatty acids, aliphatic alcohols, aliphatic ethers, urea-based compounds and hydrazide-based compounds, having in the molecule at least one C6-30 alkyl group or alkenyl group, and particularly at least one C6-30 straight-chain alkyl, straight-chain alkenyl, branched alkyl or branched alkenyl group.

The ash-free friction modifier content in the lubricating oil composition of this embodiment is preferably 0.01% by mass or greater, more preferably 0.1% by mass or greater and even more preferably 0.3% by mass or greater, and preferably no greater than 3% by mass, more preferably no greater than 2% by mass and even more preferably no greater than 1% by mass, based on the total mass of the lubricating oil composition. If the ash-free friction modifier content is less than 0.01% by mass the friction reducing effect by the addition will tend to be insufficient, while if it is greater than 3% by mass, the effects of the wear-resistance additives may be inhibited, or the solubility of the additives may be reduced.

According to this embodiment, the (A) friction modifier is preferably an organic molybdenum-based friction modifier, more preferably a sulfur-containing organic molybdenum compound, and even more preferably molybdenum dithiocarbamate.

The lubricating oil composition of this embodiment comprises (B) an overbased metal salt obtained by overbasing an oil-soluble metal salt with an alkaline earth metal borate (hereunder referred to as "(B) first overbased metal salt"). This can increase the fuel efficiency performance compared to a composition not having such a construction.

The (B) first overbased metal salt used for this embodiment can be obtained by reacting an oil-soluble metal salt such as an oil-soluble alkaline earth metal sulfonate, alkaline earth metal salicylate, alkaline earth metal phenate or alkaline earth metal phosphonate, and an alkaline earth metal hydroxide or oxide, and boric acid or boric anhydride. The alkaline earth metal may be magnesium, calcium or barium, but is preferably calcium. The oil-soluble metal salt used is preferably an alkaline earth metal salicylate.

The base value of the (B) first overbased metal salt is preferably 50 mgKOH/g or greater, more preferably 100 mgKOH/g or greater, even more preferably 150 mgKOH/g or greater and most preferably 200 or greater. It is also preferably no greater than 500 mgKOH/g, more preferably no greater than 400 mgKOH/g and most preferably no greater than 300 mgKOH/g. If the base value is less than 50 the friction reducing effect by the addition will tend to be insufficient, while if the base value is greater than 500, the effects of the wear-resistance additives may be inhibited, or the solubility of the additives may be reduced. The base value, for the purpose of the invention, is the value measured according to JIS K 2501 5.2.3.

Also, the particle size of the (B) first overbased metal salt is preferably no greater than 0.1 μm and more preferably no greater than 0.05 μm.

Any production process may be employed for the (B) first overbased metal salt, and for example, it may be obtained by reacting the aforementioned oil-soluble metal salt, alkaline earth metal hydroxide or oxide with boric acid or boric anhydride for 2-8 hours at 20-200° C. in the presence of water, an alcohol such as methanol, ethanol, propanol or butanol and a diluting solvent such as benzene, toluene or xylene, and then heating the mixture at 100-200° C. to remove the water and if necessary the alcohol and diluting solvent. The specific reaction conditions may be appropriately selected according to the amounts of starting materials and reactants. Details regarding the production process are described, for example, in Japanese Unexamined Patent Application Publication SHO No. 60-116688 and Japanese Unexamined Patent Application Publication SHO No. 61-204298. Since the particle size of an oil-soluble metal salt that has been overbased with an alkaline earth metal borate, produced by the method described above, is usually no greater than 0.1 μm and the total base value is usually 100 mgKOH/g or greater, it is preferred for use in the lubricating oil composition of the invention.

The content of the (B) first overbased metal salt in the lubricating oil composition of this embodiment is preferably 0.01-30% by mass and more preferably 0.05-5% by mass, based on the total mass of the lubricating oil composition. If the content is not at least 0.01% by mass the fuel efficiency effect may only last a short period of time, and if it exceeds 30% by mass no further effect commensurate with the content may be obtained, and therefore neither extreme is preferred.

The content of the (B) first overbased metal salt in the lubricating oil composition of this embodiment is preferably 0.001% by mass or greater, more preferably 0.01% by mass or greater, even more preferably 0.03% by mass or greater and most preferably 0.05% by mass or greater, and also preferably no greater than 0.5% by mass, more preferably no greater than 0.4% by mass, even more preferably no greater than 0.3% by mass and most preferably no greater than 0.2% by mass, in terms of the metal element based on the total mass of the lubricating oil composition. If the content is less than 0.001% by mass, the friction reducing effect of the addition will tend to be insufficient, and the fuel efficiency, the heat and oxidation stability and the cleanability of the lubricating oil composition will tend to be insufficient. If the content is greater than 0.5% by mass, on the other hand, the friction reducing effect of the addition will tend to be insufficient, and the fuel efficiency of the lubricating oil composition will tend to be insufficient.

The content of the (B) first overbased metal salt in the lubricating oil composition of this embodiment, or the content of boron from component (B) in the lubricating oil composition of this embodiment, is preferably 0.001% by mass or greater, more preferably 0.005% by mass or greater, even more preferably 0.01% by mass or greater and most preferably 0.015% by mass or greater, and also preferably no greater than 0.2% by mass, more preferably no greater than 0.15% by mass, even more preferably no greater than 0.10% by mass and most preferably no greater than 0.05% by mass, in terms of boron element, based on the total mass of the lubricating oil composition. If the content is less than 0.001% by mass, the friction reducing effect of the addition will tend to be insufficient, and the fuel efficiency, the heat and oxidation stability and the cleanability of the lubricating oil composition will tend to be insufficient. If the content is greater than 0.2% by mass, on the other hand, the friction reducing effect of the addition will tend to be insufficient, and the fuel efficiency of the lubricating oil composition will tend to be insufficient.

The lubricating oil composition of this embodiment comprises (C) an overbased metal salt obtained by overbasing an oil-soluble metal salt with an alkaline earth metal carbonate (hereunder referred to as "(C) second overbased metal salt"). This can increase the fuel efficiency performance compared to a composition not having such a construction.

The (C) second overbased metal salt may be, for example, an overbased alkaline earth metal sulfonate obtained by overbasing an alkaline earth metal sulfonate with an alkaline earth metal carbonate, an overbased alkaline earth metal phenate obtained by overbasing an alkaline earth metal phenate with an alkaline earth metal carbonate, or an overbased alkaline earth metal salicylate obtained by overbasing an alkaline earth metal salicylate with an alkaline earth metal carbonate. The alkaline earth metal may be magnesium, calcium or barium, but is preferably calcium. Among these, there is most preferably used an overbased calcium salicylate obtained by overbasing an alkaline earth metal salicylate with an alkaline earth metal carbonate.

The base value of the (C) second overbased metal salt in the lubricating oil composition of this embodiment is preferably 50 mgKOH/g or greater, more preferably 100 mgKOH/g or greater, even more preferably 150 mgKOH/g or greater and most preferably 200 mgKOH/g or greater. It is also preferably no greater than 500 mgKOH/g, more preferably no greater than 400 mgKOH/g and most preferably no greater than 300 mgKOH/g. If the base value is less than 50 the friction reducing effect by the addition will tend to be insufficient, while if the base value is greater than 500, the effects of the wear-resistance additives may be inhibited, or the solubility of the additives may be reduced.

Also, the particle size of the (C) second overbased metal salt is preferably no greater than 0.1 μm and more preferably no greater than 0.05 μm.

The (C) second overbased metal salt may be produced by any desired production method. Since the particle size of an oil-soluble metal salt that has been overbased with an alkaline earth metal carbonate, produced by a common method, is usually no greater than 0.1 μm and the total base value is usually 100 mgKOH/g or greater, it is preferred for use in the lubricating oil composition of the invention.

The content of the (C) second overbased metal salt in the lubricating oil composition of this embodiment is preferably 0.01-30% by mass and more preferably 0.05-5% by mass, based on the total mass of the lubricating oil composition. If the content is not at least 0.01% by mass the fuel efficiency effect may only last a short period of time, and if it exceeds 30% by mass no further effect commensurate with the content may be obtained, and therefore neither extreme is preferred.

The content of the (C) second overbased metal salt in the lubricating oil composition of this embodiment is preferably 0.001% by mass or greater, more preferably 0.01% by mass or greater, even more preferably 0.03% by mass or greater and most preferably 0.05% by mass or greater, and also preferably no greater than 0.5% by mass, more preferably no greater than 0.4% by mass, even more preferably no greater than 0.3% by mass and most preferably no greater than 0.2% by mass, in terms of the metal element based on the total mass of the lubricating oil composition. If the content is less than 0.001% by mass, the friction reducing effect of the addition will tend to be insufficient, and the fuel efficiency, the heat and oxidation stability and the cleanability of the lubricating oil composition will tend to be insufficient. If the content is greater than 0.5% by mass, on the other hand, the friction reducing effect of the addition will tend to be insufficient, and the fuel efficiency of the lubricating oil composition will tend to be insufficient.

The total (M) of the metal content from component (B) and the metal content from component (C) in the lubricating oil composition of this embodiment is preferably 0.01% by mass or greater, more preferably 0.05% by mass or greater, even more preferably 0.1% by mass or greater and most preferably 0.15% by mass or greater, and also preferably no greater than 0.5% by mass, more preferably no greater than 0.4% by mass, even more preferably no greater than 0.3% by mass and most preferably no greater than 0.2% by mass, in terms of the metal element based on the total mass of the lubricating oil composition. If the content is less than 0.01% by mass, the friction reducing effect of the addition will tend to be insufficient, and the fuel efficiency, the heat and oxidation stability and the cleanability of the lubricating oil composition will tend to be insufficient. If the content is greater than 0.5% by mass, on the other hand, the friction reducing effect of the addition will tend to be insufficient, and the fuel efficiency of the lubricating oil composition will tend to be insufficient.

From the viewpoint of excellent fuel efficiency, the weight ratio (M/MB) between the total (M) of the metal content from component (B) and the metal content from component (C), and the boron content (MB) from component (B) in the lubricating oil composition of this embodiment, is preferably at least 0.1, more preferably at least 1, even more preferably at least 2 and most preferably at least 3. M/MB is also preferably no greater than 50, more preferably no greater than 20, even more preferably no greater than 10 and most preferably no greater than 8.

Also, from the viewpoint of excellent fuel efficiency, the weight ratio (Mo/MB) between the molybdenum content from component (A) (Mo) and the boron content (MB) from component (B) in the lubricating oil composition of this embodiment, is preferably at least 0.1, more preferably at least 0.5, even more preferably at least 1 and most preferably at least 1.5. M/MB is also preferably no greater than 20, more preferably no greater than 10, even more preferably no greater than 5 and most preferably no greater than 3.

The lubricating oil composition of this embodiment also preferably comprises (D) a viscosity index improver with a PSSI of no greater than 40 and a ratio between the molecular weight and PSSI (Mw/PSSI) of $1\times10^4$ or greater (hereunder referred to as "(D) viscosity index improver").

The (D) viscosity index improver may be a non-dispersed or dispersed poly(meth)acrylate-based viscosity index improver, a non-dispersed or dispersed olefin-(meth)acrylate copolymer-based viscosity index improver, a non-dispersed or dispersed ethylene-α-olefin copolymer-based viscosity index improver, or a hydrogenated form thereof, a polyisobutylene-based viscosity index improver or a hydrogenated form thereof, a styrene-diene hydrogenated copolymer-based viscosity index improver, a styrene-maleic anhydride ester copolymer-based viscosity index improver or a polyalkylstyrene-based viscosity index improver, but it is preferably a non-dispersed or dispersed poly(meth)acrylate-based viscosity index improver.

The poly(meth)acrylate-based viscosity index improvers to be used for this embodiment (where, "poly(meth)acrylate-based", according to the invention, collectively includes polyacrylate-based compounds and polymethacrylate-based compounds) is preferably a polymer of polymerizable monomers that include (meth)acrylate monomers represented by the following formula (1) (hereunder referred to as "monomer M-1").

[Chemical Formula 1]

(1)

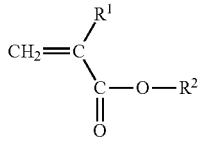

[In formula (1), $R^1$ represents hydrogen or methyl and $R^2$ represents a C1-200 straight-chain or branched hydrocarbon group.]

The poly(meth)acrylate-based compound obtained by copolymerization of a homopolymer of one monomer represented by formula (1) or copolymerization of two or more thereof is a "non-dispersed poly(meth)acrylate", but the poly(meth)acrylate-based compound of the invention may also be a "dispersed poly(meth)acrylate" in which a monomer represented by formula (1) is copolymerized with one or more monomers selected from among formulas (2) and (3) (hereunder referred to as "monomer M-2" and "monomer M-3", respectively).

[Chemical Formula 2]

(2)

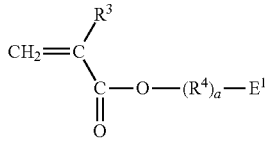

[In formula (2), $R^3$ represents hydrogen or methyl, $R^4$ represents a C1-18 alkylene group, $E^1$ represents an amine residue or heterocyclic residue containing 1-2 nitrogen atoms and 0-2 oxygen atoms, and a is 0 or 1.]

[Chemical Formula 3]

(3)

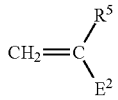

[In formula (3), $R^5$ represents hydrogen or methyl and $E^2$ represents an amine residue or heterocyclic residue containing 1-2 nitrogen atoms and 0-2 oxygen atoms.]

Specific examples of groups represented by $E^1$ and $E^2$ include dimethylamino, diethylamino, dipropylamino, dibutylamino, anilino, toluidino, xylidino, acetylamino, benzoylamino, morpholino, pyrrolyl, pyrrolino, pyridyl, methylpyridyl, pyrrolidinyl, piperidinyl, quinonyl, pyrrolidonyl, pyrrolidono, imidazolino and pyrazino.

Specific preferred examples for monomer M-2 and monomer M-3 include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholinoethyl methacrylate, N-vinylpyrrolidone, and mixtures of the foregoing.

There are no particular restrictions on the molar ratio of copolymerization in the copolymer of monomer M-1 and monomers M-2 and M-3, but preferably it is a ratio of approximately M-1:M-2-M-3=99:1-80:20, more preferably 98:2-85:15 and even more preferably 95:5-90:10.

Any production process may be employed for the poly (meth)acrylate of the third embodiment, and for example, it can be easily obtained by radical solution polymerization of a mixture of monomer (M-1) and monomers (M-2) and (M-3) in the presence of a polymerization initiator such as benzoyl peroxide.

The (D) viscosity index improver used in the lubricating oil composition of this embodiment may be, instead of the aforementioned non-dispersed or dispersed poly(meth)acrylate, a viscosity index improver such as a non-dispersed or dispersed ethylene-α-olefin copolymer, or a hydrogenated form thereof, a polyisobutylene or a hydrogenated form thereof, a styrene-diene hydrogenated copolymer, a styrene-maleic anhydride ester copolymer, or a polyalkylstyrene and a copolymer of a (meth)acrylate monomer represented by structural formula (1) and an unsaturated monomer such as ethylene/propylene/styrene/maleic anhydride.

The PSSI (Permanent Shear Stability Index) of the (D) viscosity index improver is preferably no greater than 40, more preferably no greater than 35, even more preferably no greater than 30 and most preferably no greater than 25. It is also preferably 0.1 or greater, more preferably 0.5 or greater, even more preferably 2 or greater and most preferably 5 or greater. If the PSSI is less than 0.1 the viscosity index improving effect may be reduced and cost increased, while if the PSSI is greater than 40 the shear stability or storage stability may be impaired.

The weight-average molecular weight ($M_W$) of the (D) viscosity index improver is preferably 100,000 or greater, more preferably 200,000 or greater, even more preferably 250,000 or greater and most preferably 300,000 or greater. It is also preferably no greater than 1,000,000, more preferably no greater than 700,000, even more preferably no greater than 600,000 and most preferably no greater than 500,000. If the weight-average molecular weight is less than 100,000, the effect of improving the viscosity-temperature characteristic and viscosity index will be minimal, potentially increasing cost, while if the weight-average molecular weight is greater than 1,000,000 the shear stability, solubility in the base oil and storage stability may be impaired.

The number-average molecular weight ($M_N$) of the (D) viscosity index improver is preferably 50,000 or greater, more preferably 800,000 or greater, even more preferably 100,000 or greater and most preferably 120,000 or greater. It is also preferably no greater than 500,000, more preferably no greater than 300,000, even more preferably no greater than 250,000 and most preferably no greater than 200,000. If the number-average molecular weight is less than 50,000, the effect of improving the viscosity-temperature characteristic and viscosity index will be minimal, potentially increasing cost, while if the weight-average molecular weight is greater than 500,000 the shear stability, solubility in the base oil and storage stability may be impaired.

The ratio of the weight-average molecular weight and PSSI of the (D) second viscosity index improver ($M_W$/PSSI) is preferably $1.0\times10^4$ or greater, more preferably $1.5\times10^4$ or greater, even more preferably $2.0\times10^4$ or greater, yet more preferably $2.5\times10^4$ or greater and most preferably $3.0\times10^4$ or greater. If the $M_W$/PSSI ratio is less than $1.0\times10^4$, the viscosity-temperature characteristic, i.e. the fuel efficiency, may be impaired.

The ratio between the weight-average molecular weight and number-average molecular weight of the (D) viscosity index improver ($M_W/M_N$) is preferably 0.5 or greater, more preferably 1.0 or greater, even more preferably 1.5 or greater, yet more preferably 2.0 or greater and most preferably 2.1 or greater. Also, $M_W/M_N$ is preferably no greater than 6.0, more preferably no greater than 4.0, even more preferably no greater than 3.5 and most preferably no greater than 3.0. If $M_W/M_N$ is less than 0.5 or greater than 6.0, the viscosity-temperature characteristic may be impaired, or in other words the fuel efficiency may be reduced.

The increase in the 40° C. and 100° C. kinematic viscosity of the (D) viscosity index improver (ΔKV40/ΔKV100) is preferably no greater than 4.0, more preferably no greater than 3.5, even more preferably no greater than 3.0, yet more preferably no greater than 2.5, and most preferably no greater than 2.3. Also, ΔKV40/ΔKV100 is preferably 0.5 or greater, more preferably 1.0 or greater and even more preferably 1.5 or greater. If ΔKV40/ΔKV100 is less than 0.5 the viscosity-increasing effect or solubility may be reduced and cost may be increased, while if it exceeds 4.0 the viscosity-temperature characteristic-improving effect or low-temperature viscosity characteristic may be inferior. ΔKV40 is the amount of increase in the 40° C. kinematic viscosity when the viscosity index improver is added at 3.0% to YUBASE4 by SK Corp., and ΔKV100 is the amount of increase in the 100° C. kinematic viscosity when the viscosity index improver is added at 3.0% to YUBASE4 by SK Corp.

The ratio of the 100° C. and 150° C. HTHS viscosities of the (D) viscosity index improver (ΔHTHS100/ΔHTHS150) is preferably no greater than 2.0, more preferably no greater than 1.7, even more preferably no greater than 1.6 and most preferably no greater than 1.55. Also, ΔHTHS100/ΔHTHS150 is preferably 0.5 or greater, more preferably 1.0 or greater, even more preferably 1.2 or greater and most preferably 1.4 or greater.

If it is less than 0.5 the viscosity-increasing effect or solubility may be reduced and cost may be increased, while if it exceeds 2.0 the viscosity-temperature characteristic-improving effect or low-temperature viscosity characteristic may be inferior.

ΔHTHS100 is the amount of increase in the 100° C. HTHS viscosity when the viscosity index improver is added at 3.0% to YUBASE4 by SK Corp., and ΔHTHS150 is the amount of increase in the 150° C. HTHS viscosity when the viscosity index improver is added at 3.0% to YUBASE4 by SK Corp. Also, ΔHTHS100/ΔHTHS150 is the ratio between the increase in the 100° C. HTHS viscosity and the increase in the 150° C. HTHS viscosity. The 100° C. HTHS viscosity is the high-temperature high-shear viscosity at 100° C. according to ASTM D4683. The 150° C. HTHS viscosity is the high-temperature high-shear viscosity at 150° C. according to ASTM D4683.

The (D) viscosity index improver content of the lubricating oil composition of this embodiment is preferably 0.01-50% by mass, more preferably 0.5-40% by mass, even more preferably 1-30% by mass, yet more preferably 3-20% by mass and most preferably 5-10% by mass, based on the total mass of the lubricating oil composition. If the viscosity index improver content is less than 0.1% by mass, the viscosity index improving effect or product viscosity reducing effect will be minimal, potentially preventing improvement in fuel efficiency. A content of greater than 50% by mass will drastically increase production cost while requiring reduced base oil viscosity, and can thus risk lowering the lubricating performance under severe lubrication conditions (high-temperature, high-shear conditions), as well as causing problems such as wear, seizing and fatigue fracture.

The lubricating oil composition of this embodiment may further contain any additives commonly used in lubricating oils, for the purpose of enhancing performance. Examples of such additives include additives such as metal cleaning agents other than the aforementioned first and second overbased metal salts, non-ash powders, antioxidants, anti-wear agents (or extreme-pressure agents), corrosion inhibitors, rust-preventive agents, demulsifiers, metal inactivating agents and antifoaming agents.

The metal cleaning agents other than the aforementioned first and second overbased metal salts include normal salts or basic salts such as alkali metal/alkaline earth metal sulfonates, alkali metal/alkaline earth metal phenates and alkali metal/alkaline earth metal salicylates. Alkali metals include sodium and potassium and alkaline earth metals include magnesium, calcium and barium, with magnesium and calcium being preferred, and calcium being especially preferred.

As non-ash powders there may be used any non-ash powders used in lubricating oils, examples of which include mono- or bis-succinic acid imides with at least one C40-400 straight-chain or branched alkyl group or alkenyl group in the molecule, benzylamines with at least one C40-400 alkyl group or alkenyl group in the molecule, polyamines with at least one C40-400 alkyl group or alkenyl group in the molecule, and modified forms of the foregoing with boron compounds, carboxylic acids, phosphoric acids and the like. One or more selected from among any of the above may be added for use.

As antioxidants there may be mentioned phenol-based and amine-based ash-free antioxidants, and copper-based or molybdenum-based metal antioxidants. Specific examples include phenol-based ash-free antioxidants such as 4,4'-methylenebis(2,6-di-tert-butylphenol) and 4,4'-bis(2,6-di-tert-butylphenol), and amine-based ash-free antioxidants such as phenyl-α-naphthylamine, alkylphenyl-α-naphthylamine and dialkyldiphenylamine.

As anti-wear agents (or extreme-pressure agents) there may be used any anti-wear agents and extreme-pressure agents that are utilized in lubricating oils. For example, sulfur-based, phosphorus-based and sulfur/phosphorus-based extreme-pressure agents may be used, specific examples of which include phosphorous acid esters, thiophosphorous acid esters, dithiophosphorous acid esters, trithiophosphorous acid esters, phosphoric acid esters, thiophosphoric acid esters, dithiophosphoric acid esters and trithiophosphoric acid esters, as well as their amine salts, metal salts and their derivatives, dithiocarbamates, zinc dithiocarbamate, molybdenum dithiocarbamate, disulfides, polysulfides, olefin sulfides, sulfurized fats and oils, and the like. Sulfur-based extreme-pressure agents, and especially sulfurized fats and oils, are preferably added.

Examples of corrosion inhibitors include benzotriazole-based, tolyltriazole-based, thiadiazole-based and imidazole-based compounds.

Examples of rust-preventive agents include petroleum sulfonates, alkylbenzene sulfonates, dinonylnaphthalene sulfonates, alkenylsuccinic acid esters and polyhydric alcohol esters.

Examples of demulsifiers include polyalkylene glycol-based nonionic surfactants such as polyoxyethylenealkyl ethers, polyoxyethylenealkylphenyl ethers and polyoxyethylenealkylnaphthyl ethers.

Examples of metal inactivating agents include imidazolines, pyrimidine derivatives, alkylthiadiazoles, mercaptobenzothiazoles, benzotriazole and its derivatives, 1,3,4-thiadiazolepolysulfide, 1,3,4-thiadiazolyl-2,5-bisdialkyl dithiocarbamate, 2-(alkyldithio)benzimidazole and β-(o-carboxybenzylthio)propionitrile.

Examples of antifoaming agents include silicone oils, alkenylsuccinic acid derivatives, polyhydroxyaliphatic alcohol and long-chain fatty acid esters, methyl salicylate and o-hydroxybenzyl alcohols, which have 25° C. kinematic viscosities of 1000-100,000 $mm^2/s$.

When such additives are added to the lubricating oil composition of this embodiment, their contents are 0.01-10% by mass based on the total mass of the lubricating oil composition.

The 100° C. kinematic viscosity of the lubricating oil composition of this embodiment is preferably no greater than 4-12 $mm^2/s$, more preferably no greater than 9 $mm^2/s$, even more preferably no greater than 8 $mm^2/s$, yet more preferably no greater than 7.8 $mm^2/s$, and most preferably no greater than 7.6 $mm^2/s$. The 100° C. kinematic viscosity of the lubricating oil composition of the invention is preferably 5 $mm^2/s$ or greater, more preferably 6 $mm^2/s$ or greater, even more preferably 6.5 $mm^2/s$ or greater and most preferably 7 $mm^2/s$ or greater. The 100° C. kinematic viscosity is the 100° C. kinematic viscosity measured according to ASTM D-445. If the 100° C. kinematic viscosity is less than 4 $mm^2/s$, insufficient lubricity may result, and if it is greater than 12 $mm^2/s$ it may not be possible to obtain the necessary low-temperature viscosity and sufficient fuel efficiency performance.

The 40° C. kinematic viscosity of the lubricating oil composition of this embodiment is preferably 4-50 $mm^2/s$, more preferably no greater than 40 $mm^2/s$, even more preferably no greater than 35 $mm^2/s$, yet more preferably no greater than 32 $mm^2/s$ and most preferably no greater than 30 $mm^2/s$. The 40° C. kinematic viscosity of the lubricating oil composition of the invention is preferably 10 $mm^2/s$ or greater, more preferably 20 $mm^2/5$ or greater, even more preferably 25 $mm^2/s$ or greater and most preferably 27 $mm^2/s$ or greater. The 40° C. kinematic viscosity is the kinematic viscosity at 40° C., measured according to ASTM D-445. If the 40° C. kinematic viscosity is less than 4 $mm^2/s$, insufficient lubricity may result, and if it is greater than 50 $mm^2/s$ it may not be possible to obtain the necessary low-temperature viscosity and sufficient fuel efficiency performance.

The viscosity index of the lubricating oil composition of this embodiment is preferably in the range of 140-400, and it is preferably 190 or greater, more preferably 200 or greater, even more preferably 210 or greater and most preferably 220 or greater. If the viscosity index of the lubricating oil composition of the invention is less than 140 it may be difficult to maintain the 150° C. HTHS viscosity while improving fuel efficiency, and it may also be difficult to lower the −35° C. low-temperature viscosity. If the viscosity index of the lubricating oil composition of this embodiment is greater than 400 the evaporation property may be poor, and problems may occur due to solubility of the additives or lack of compatibility with the sealant material.

The 100° C. HTHS viscosity of the lubricating oil composition of this embodiment is preferably no greater than 5.5 mPa·s, more preferably no greater than 5.0 mPa·s, even more preferably no greater than 4.8 mPa·s and most preferably no greater than 4.7 mPa·s. It is also preferably 3.0 mPa·s or greater, even more preferably 3.5 mPa·s or greater, yet more preferably 4.0 mPa·s or greater and most preferably 4.2 mPa·s or greater. The 100° C. HTHS viscosity, according to the invention, is the high-temperature high-shear viscosity at 100° C. according to ASTM D4683. If the 100° C. HTHS viscosity is less than 3.0 mPa·s, insufficient lubricity may result, and if it is greater than 5.5 mPa·s it may not be possible to obtain the necessary low-temperature viscosity and sufficient fuel efficiency performance.

The 150° C. HTHS viscosity of the lubricating oil composition of this embodiment is preferably no greater than 3.5 mPa·s, more preferably no greater than 3.0 mPa·s, even more preferably no greater than 2.8 mPa·s and most preferably no greater than 2.7 mPa·s. It is also preferably 2.0 mPa·s or greater, more preferably 2.3 mPa·s or greater, even more preferably 2.4 mPa·s or greater, yet more preferably 2.5 mPa·s or greater and most preferably 2.6 mPa·s or greater. The 150° C. HTHS viscosity is the high-temperature high-shear viscosity at 150° C. according to ASTM D4683. If the 150° C. HTHS viscosity is less than 2.0 mPa·s, insufficient lubricity may result, and if it is greater than 3.5 mPa·s it may not be possible to obtain the necessary low-temperature viscosity and sufficient fuel efficiency performance.

Also, the ratio of the 150° C. HTHS viscosity and the 100° C. HTHS viscosity of the lubricating oil composition of this embodiment (150° C. HTHS viscosity/100° C. HTHS viscosity) is preferably 0.50 or greater, more preferably 0.52 or greater, even more preferably 0.54, yet more preferably 0.55 or greater and most preferably 0.56 or greater. If the ratio is less than 0.50, it may not be possible to obtain the necessary low-temperature viscosity and sufficient fuel efficiency performance.

The lubricating oil composition of this embodiment has excellent fuel efficiency and lubricity, and is effective for improving fuel efficiency while maintaining a constant level for the 150° C. HTHS viscosity, even without using a synthetic oil such as a poly-α-olefinic base oil or esteric base oil or a low-viscosity mineral base oil, because it reduces the 40° C. and 100° C. kinematic viscosity and the 100° C. HTHS viscosity of lubricating oils. The lubricating oil composition of the invention having such superior properties can be suitably employed as a fuel efficient engine oil, such as a fuel efficient gasoline engine oil or fuel efficient diesel engine oil.

EXAMPLES

The present invention will now be explained in greater detail based on examples and comparative examples, with the understanding that these examples are in no way limitative on the invention.

Examples 1-3, Comparative Examples 1-4

For Examples 1-3 and Comparative Examples 1-4 there were prepared lubricating oil compositions having the compositions shown in Table 2, using the base oils and additives listed below. The properties of base oils O-1 and O-2 are shown in Table 1.

(Base Oils)

O-1 (Base oil 1): Mineral oil obtained by hydrotreatment/hydroisomerization of n-paraffin-containing oil O-2 (Base oil 2): Hydrocracked mineral oil (Additives)

A-1: MoDTC (Mo content: 10 mass %)

B-1: Overbased calcium borate salicylate (base value: 190 mgKOH/g, Ca content=6.8%, B content=2.7%)

C-1: Overbased calcium salicylate (base value: 170 mgKOH/g, Ca content=6.3%)

D-1: Polymethacrylate (ΔKV40/ΔKV100=1.6, ΔHTHS100/ΔHTHS150=1.48, MW=400,000, PSSI=4, Mw/Mn=3.1, Mw/PSSI=100,000)

d-2: Dispersed polymethacrylate (ΔKV40/ΔKV100=3.3, ΔHTHS100/ΔHTHS150=1.79, MW=300,000, PSSI=40, Mw/Mn=4.0, Mw/PSSI=7500)

e-1: Imide-based succinate dispersing agent (Mw=13,000)

f-1: Other additives (antioxidants, anti-wear agents, pour point depressants, antifoaming agents, etc.).

TABLE 1

| | | | Base oil 1 | Base oil 2 |
|---|---|---|---|---|
| Density | (15° C.) | g/cm$^3$ | 0.825 | 0.8388 |
| Kinematic viscosity | (40° C.) | mm$^2$/s | 17.75 | 18.72 |
| | (100° C.) | mm$^2$/s | 4.073 | 4.092 |
| Viscosity index | | | 132 | 120 |
| Flow point | | ° C. | −22.5 | −22.5 |
| Aniline point | | ° C. | 119.1 | 111.6 |
| Sulfur content | | ppm by mass | <1 | 2 |
| Nitrogen content | | ppm by mass | <3 | <3 |
| n-d-M analysis | | % $C_P$ | 87.3 | 78 |
| | | % $C_N$ | 12.7 | 20.7 |
| | | % $C_A$ | 0 | 1.3 |
| Chromatographic separation mass % | | Saturated content | 99.6 | 95.1 |
| | | Aromatic content | 0.2 | 4.7 |
| | | Resin content | 0.2 | 0.2 |
| | | Yield | 100 | 100 |
| Paraffin content based on saturated components | | mass % | | 50.6 |
| Naphthene content based on saturated components | | mass % | | 49.4 |

[Evaluation of Lubricating Oil Compositions]

Each of the lubricating oil compositions of Examples 1 to 3 and Comparative Examples 1 to 4 was measured for 40° C. or 100° C. kinematic viscosity, viscosity index and 100° C. or 150° C. HTHS viscosity. The fuel efficiency was measured by measuring the engine friction. The physical property values and fuel efficiency were measured by the following evaluation methods. The obtained results are shown in Table 2.

(1) Kinematic viscosity: ASTM D-445

(2) Viscosity index: JIS K 2283-1993

(3) HTHS viscosity: ASTM D-4683

(4) Engine friction test: Using a 2 L engine, the average value for friction at different measuring points at an oil temperature of 100° C. and rotational speeds of 500-1500 rpm was calculated, and the friction improvement rate was calculated with respect to Comparative Example 2 as the reference oil.

TABLE 2

| | | | Units | Example 1 | Example 2 | Example 3 | Comp. Ex. 1 | Comp. Ex. 2 | Comp. Ex. 3 | Comp. Ex. 4 |
|---|---|---|---|---|---|---|---|---|---|---|
| Base oil | Based on total base oil | | | | | | | | | |
| O-1 | Base oil 1 | | mass % | 100 | 100 | 100 | 100 | 100 | | 100 |
| O-2 | Base oil 2 | | mass % | | | | | | 100 | |
| Additives | Based on total composition | | | | | | | | | |
| A-1 | MoDTC | | mass % | 0.8 | 0.8 | 0.8 | 0.8 | 0.8 | 0.8 | 0.8 |
| B-1 | Overbased borate Ca salicylate | | mass % | 1.5 | 0.8 | 2.3 | | 3.1 | 3.1 | 3.1 |
| C-1 | Overbased Ca salicylate | | mass % | 1.5 | 2.2 | 0.8 | 2.9 | | | |
| D-1 | Polymethacrylate | | mass % | 13 | 13 | 13 | 13 | 12.4 | | |
| d-2 | Dispersed polymethacrylate | | mass % | | | | | | 4.5 | 4.5 |
| e-1 | Succinic acid imide | | mass % | 5 | 5 | 5 | 5 | 5 | 5 | 5 |
| f-1 | Other additives | | mass % | 3 | 3 | 3 | 3 | 3 | 3 | 3 |
| Metal content | Mo content | | ppm | 800 | 800 | 800 | 800 | 800 | 800 | 0 |
| | Ca content | | ppm | 2000 | 1900 | 2100 | 1800 | 2100 | 2100 | 2100 |
| | B content | | ppm | 400 | 200 | 600 | 0 | 800 | 800 | 800 |
| Metal ratio | Mo/MB | | | 2 | 4 | 1.3 | 1 | — | — | 0 |
| | M/MB | | | 5 | 9.5 | 3.5 | 2.5 | — | — | 5 |
| Evaluation results | | | | | | | | | | |
| Kinematic viscosity | | 40° C. | $mm^2/s$ | 28.7 | 28.8 | 28.8 | 28.8 | 28.4 | 40.8 | 28.3 |
| | | 100° C. | $mm^2/s$ | 7.3 | 7.3 | 7.3 | 7.3 | 7.1 | 8.8 | 7.2 |
| Viscosity index | | | | 235 | 237 | 237 | 237 | 231 | 202 | 236 |
| HTHS viscosity | | 100° C. | mPa · s | 4.9 | 5.0 | 5.0 | 5.0 | 4.9 | 5.3 | 4.8 |
| | | 150° C. | mPa · s | 2.6 | 2.6 | 2.6 | 2.6 | 2.6 | 2.6 | 2.5 |
| Motoring friction improvement rate | | | % | 2.5 | 1.5 | 1.5 | 1.2 | 0.0 | −2.1 | −6.3 |

As shown in Table 2, the lubricating oil compositions of Examples 1-3 which contained all of components (A) to (C) exhibited higher friction improvement rates in the engine friction test and more excellent fuel efficiency, compared to the lubricating oil compositions of Comparative Examples 1 and 2 which had equivalent 150° C. HTHS viscosities but did not contain component (B) or component (C). In addition, the engine friction property was significantly inferior with the lubricating oil composition of Comparative Example 3, which employed a viscosity index improver with a PSSI of 40 or greater and a molecular weight/PSSI ratio of $1\times10^4$ or greater, and did not contain component (C). The engine friction property was also significantly inferior with the lubricating oil composition of Comparative Example 4, which did not contain component (A).

The invention claimed is:

1. A lubricating oil composition comprising:

a lubricating base oil with a 100° C. kinematic viscosity of 1-20 $mm^2/s$, molybdenum dithiocarbamate (MoDTC) in an amount of 0.03-0.1% by mass in terms of molybdenum element and based on the total mass of the lubricating oil composition, a first overbased metal salt obtained by overbasing an oil-soluble metal salt with an alkaline earth metal borate in an amount of 0.05-5% by mass based on the total mass of the lubricating oil composition, a second overbased metal salt obtained by overbasing an oil-soluble metal salt with an alkaline earth metal carbonate in an amount of 0.05-2.2% by mass based on the total mass of the lubricating oil composition, and 3-20% by mass based on the total mass of the lubricating composition of a poly(meth)acrylate-based viscosity index improver with a PSSI of no greater than 35 and a ratio between the molecular weight and PSSI (Mw/PSSI) of $1\times10^4$ or greater;

wherein the total of the metal content from the first overbased metal salt and from the second overbased metal salt in the lubricating oil composition is 0.1 to 0.3% by mass.

2. A lubricating oil composition according to claim 1, wherein the first overbased metal salt is an overbased alkaline earth metal salicylate obtained by overbasing an alkaline earth metal salicylate with an alkaline earth metal borate.

* * * * *